United States Patent [19]

Kitashima et al.

[11] 4,325,994

[45] Apr. 20, 1982

[54] COATING METAL FOR PREVENTING THE CREVICE CORROSION OF AUSTENITIC STAINLESS STEEL AND METHOD OF PREVENTING CREVICE CORROSION USING SUCH METAL

[75] Inventors: Nobumitsu Kitashima, Chigasaki; Norio Takahashi, Yamato; Juichi Ishiguro, Kanagawa; Satoshi Kawamura, Chigasaki, all of Japan

[73] Assignee: Ebara Corporation, Tokyo, Japan

[21] Appl. No.: 218,684

[22] Filed: Dec. 22, 1980

[30] Foreign Application Priority Data

Dec. 29, 1979 [JP] Japan ..... 55-194
Dec. 29, 1979 [JP] Japan ..... 55-195
Dec. 29, 1979 [JP] Japan ..... 55-196
Dec. 29, 1979 [JP] Japan ..... 55-197

[51] Int. Cl.[3] ..... A32B 15/18; C23C 7/00

[52] U.S. Cl. ..... 427/376.8; 427/34; 427/423; 428/667; 428/679; 75/171

[58] Field of Search ..... 428/667, 679, 685; 427/423, 376.8, 383.7, 383.9, 431, 34; 75/171

[56] References Cited

U.S. PATENT DOCUMENTS 2,392,821 1/1946 Kreag ..... 428/679
4,075,999 2/1978 Danis ..... 428/679
4,092,183 5/1978 Grundy ..... 75/171
4,171,217 10/1979 Asphahani et al. ..... 75/171

FOREIGN PATENT DOCUMENTS 7743736 4/1977 Japan ..... 427/34

*Primary Examiner*—Ralph S. Kendall
*Attorney, Agent, or Firm*—Oblon, Fisher, Spivak, McClelland & Maier

[57] ABSTRACT

This invention provides a good coating metal capable of achieving permanent protection from crevice corrosion of austenitic stainless steel placed in corrosive environments. The coating metal of this invention is a Ni-base, Co-base or Ni-Co base metal by having incorporated therein a suitable amount of Cr, Mo, Fe, Si B, and other elements.

10 Claims, 13 Drawing Figures

COATING METAL FOR PREVENTING THE CREVICE CORROSION OF AUSTENITIC STAINLESS STEEL AND METHOD OF PREVENTING CREVICE CORROSION USING SUCH METAL

BACKGROUND OF THE INVENTION

1. Field of the Invention

This invention relates to a coating metal for preventing the crevice corrosion of austenitic stainless steel and a method of preventing crevice corrosion using such metal. More particularly, the invention relates to a coating metal for preventing crevice corrosion that attacks the interface of austenitic stainless steel and another object both of which are in a liquid. The invention also relates to a method of preventing such crevice corrosion.

2. Description of the Prior Art

Apparatus, equipment and component parts which are kept in contact with seawater or other corrosive liquids are made of a corrosion-resistant metallic material which is selected from among cast iron, copper alloy and stainless steel and other materials depending upon the hostility of the environments in which such material is used. Among these corrosion-resistant materials, austenitic stainless steel is known to be particularly effective and has been employed in a wide range of corrosive environments. Austenitic stainless steel exhibits the desired effect in an environment where the corrosive liquid is moving, but as the flow rate of the fluid decreases, and diffusion of the oxygen in the fluid is slowed, the corrosion potential at the austenitic stainless steel becomes anodic and local corrosion occurs easily. For instance, if a pump for conveying the seawater and its piping and valve system are made of austenitic stainless steel, crevice corrosion easily develops in the interface of two austenitic stainless steel components that are in contact with the seawater, such as the interface of the flanges attached to the suction port of the pump and the connecting pipe, the interface of the flanges attached to the discharge port of the pump and the connecting pipe, the mating surface of the casing parts, and the interface of the flanges for connecting the pipe to a valve. The mechanism of the development of crevice corrosion is as follows: the seawater entering the crevice that is unavoidably formed between two fitting parts is seldom replaced by the seawater outside the crevice, so the pH of the seawater within the crevice decreases and the concentration of chlorine ions in that seawater increases. As a result, a crevice corrosion develops due to the galvanic action that works between the interface and the surface other than the interface which is in contact with a substantially neutral environment, and such corrosion keeps going on unless the seawater within the crevice is replaced by the external seawater. One method that has been proposed to prevent such crevice corrosion is to fill the crevice with a joint sheet impregnated with an alkaline or oxidizing substance (Japanese Patent Public Disclosure Nos. 20954, 20955/1975). But such joint sheet can be used only in a crevice (i.e. the sheet has limited applicability) and its effectiveness does not last for an extended period.

BRIEF DESCRIPTION OF THE DRAWING

In FIG. 4, the line A-E satisfies the equation: Mo%+0.8 Cr%=20, and the respective points represent the following compositions: A=10% Cr and 12% Mo, B=10% Cr and 35% Mo, C=50% Cr and 35% Mo, D=50% Cr and 3% Mo, E=21.25% Cr and 3% Mo, F=15% Cr and 8% Mo, G=35% Cr and 8% Mo, and H=35% Cr and 3% Mo.

SUMMARY OF THE INVENTION

Figure 1:
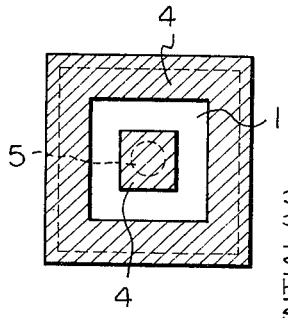
FIG. 1 is a front view of a setup for testing the coating metal of this invention.

One object of this invention is to provide a good coating metal capable of achieving permanent protection from crevice corrosion of austenitic stainless steel placed corrosive environments.

Another object of this invention is to provide a method of achieving permanent protection of austenitic stainless steel from crevice corrosion by applying to the surface of the stainless steel a layer of a coating metal highly effective in prevention of crevice corrosion, and melting said coating metal on the stainless steel with heat.

Other objects and advantages of this invention may become apparent to those skilled in the art from the following description and disclosure.

DESCRIPTION OF THE PREFERRED EMBODIMENTS

To achieve these objects, we made studies on a method for preventing the crevice corrosion of austenitic stainless steel in corrosive environments by applying a coating of another metallic material onto the area of the stainless steel that is to be in contact with another object or the area that surrounds such area, as well as on the coating metal used in such method. In consequence, we found the following.

(1) The crevice corrosion of austenitic stainless steel can be prevented by applying a certain type of Ni-base, Co-base or Ni-Co base alloy to be described herein onto the area of the stainless steel that is to be in contact with another object in corrosive environments or the area that surrounds such area.

(2) The effectiveness of such coating metal decreases greatly if there are openings within the layer of the coating metal or if it contains impurities such as an oxide.

(3) Therefore, the Ni-base, Co-base or Ni-Co base alloy being applied must become liquid temporarily on the surface of the base metal or austenitic stainless steel, and for this reason, the coating metal used in preventing the crevice corrosion of austenitic stainless steel must have a melting point no higher than the melting point of the base metal (1430° C.). The lower the melting point of the coating metal, the easier the gunning of the metal onto austenitic stainless steel.

The coating metal of this invention is a Ni-base alloy, Co-base alloy or an alloy containing Ni and Co in a desired proportion. We have confirmed empirically that Ni and Co are almost equal in their ability to prevent the crevice corrosion of austenitic stainless steel. Therefore, the Ni-base alloy used as the coating metal of this invention is capable of preventing the crevice corrosion of austenitic stainless steel even if part or all of the Ni content is replaced by Co. However, no alloy made of only Ni, Co or Ni and Co is able to achieve the desired effect. Therefore, the coating metal of this invention is a Ni-base, Co-base or Ni-Co base metal that has the ability to prevent the crevice corrosion of austenitic stainless steel by having incorporated therein:

a suitable amount of Cr and Mo;

a suitable amount of Cr, Mo and Fe;

a suitable amount of Cr, Mo and at least one element selected from the group consisting of Si and B; or a suitable amount of Cr, Mo, Fe and at least one element selected from the group consisting of Si and B; and at least one element selected from the group consisting of Nb, Ta and Ti.

The amounts of the respective ingredients in the coating metal of this invention and their criticality are described hereunder. Chromium must be contained in the coating metal of this invention in an amount between 10 and 50 wt%. Chromium is an element that passivates the metal to which it is added, and it enhances the passivity of Ni, Co or Ni-Co base metal. The melting point of the Ni, Co, or Ni-Co base metal is decreased upon addition or Cr, so the resulting coating metal is easier to be applied to austenitic stainless steel. Chromium of less than 10% is not sufficient to enhance the passivity of the Ni, Co or Ni-Co base metal and the melting point of the resulting coating metal is not low enough to achieve easy gunning onto austenitic stainless steel. Beyong 50%, chromium does not achieve significant increase in the passivity of Ni, Co or Ni-Co base metal, and it is difficult to prepare a mix for the coating metal. For these reasons, it is required that the coating metal of this invention contain 10 to 50 wt% of Cr. Preferably, the coating metal contains 15 to 35% of Cr. To form a layer of the coating metal of this invention on austenitic stainless steel, the metal must be melted temporarily on the surface of the base metal before it solidifies, and to avoid uneven distribution of the Cr level, the coating metal preferably contains 15 to 35 wt% of chromium.

Molybdenum must be contained in the coating metal of this invention in an amount between 3 and 35 wt%. Molybdenum is very effective for preventing crevice corrosion, but it is a very expensive element. Therefore, the Mo level is desirably as low as possible on the condition that its ability to prevent crevice corrosion of austenitic stainless steel is not lost. Therefore, the lower limit of the Mo content is 3%. To add more than 35% of Mo is futile because it only produces a costly coating metal without appreciably improving resistance against crevice corrosion. Therefore, the upper limit of the Mo content is 35%. But from an economical point of view, the upper limit may be 8%. If a good layer of coating metal wherein uneven distribution of Mo is minimum can be produced, it is economically desired that the Mo content be as low as possible provided that it is not less than 3%.

Iron is not only cheap but is also has the ability to improve the workability of a Ni-Cr-Mo alloy, Co-Cr-Mo alloy or Ni-Co-Cr-Mo alloy, so it is an element that is desirably contained in the coating metal of this invention. But iron must not be contained in an amount greater than 25%, because adding more than 25% of iron has an adverse effect on the corrosion resistance.

Silicon and boron have the ability to reduce the melting point of alloys as well as to improve the wettability of austenitic stainless steel by the coating metal. Since Si and B have great affinity for oxygen, they also have the ability to combine with oxygen in the layer of the coating metal and remove oxides from the layer. Such effect of silicon and boron is not produced if they are contained in an amount of less than 0.5 wt%, and no appreciable increase in that effect is obtained even if the two elements are contained in an amount of greater than 4 wt%. Therefore, to provide improved coating and assure effective protection against crevice corrosion, the coating metal of this invention preferably contains 0.5 to 4% of Si and/or B.

The coating metal of this invention contains carbon as an incidental impurity, and when heated at a temperature of about 700° C. for an extended period, it reacts with the principal alloying elements of the coating metal to form a carbide, such as $Cr_{23}C_6$, that may reduce the corrosion resistance of the coating metal. Niobium, tantalum and titanium are all effective for preventing the formation of such carbides. Niobium has the ability to prevent the formation of carbides if it is contained in an amount of at least ten times as much as C. Tantalum is also effective when it is contained in an amount of at least 10 times as much as C. Titanium is capable of preventing the formation of carbides such as $Cr_{23}C_6$ if it is contained in an amount of at least 5 times as much as C. Niobium, tantalum and titanium may be contained independently or as a mixture of two or three elements in any proportion. Therefore, Nb, Ta and Ti may be contained in such an amount that the following relation is satisfied: $Nb\% + Ta\% + 2Ti\% > 10\ C\%$. If the presence of C as an incidental impurity is concentrated locally, the above relation is preferably modified to: $NB\% + Ta\% + 2Ti\% > 15\ C\%$.

The coating metal of this invention also contains sulfur as an incidental impurity which causes high-temperature cracking during application of the coating metal. An effective method of preventing this is to have less than 2.5% of Mn in the coating metal. Beyond 2.5%, no appreciable effect is obtained, so the upper limit of S shall be 2.5%.

This invention is now described in greater detail by reference to the following examples.

EXAMPLE 1

Nickel-based coating metal samples Nos. 1 to 43 of this invention, conventional samples Nos. 1 to 5 and control samples Nos. 1 to 21 were prepared. The amounts of the respective alloying elements are shown in Table 1 together with the results of crevice corrosion tests conducted with these samples. In Table 1, the conventional coating metal sample No. 1 was austenitic stainless steel (SUS 316L), sample No. 5 was a coating metal made of only nickel, sample No. 2 was composed of Ni+10% Cr alloy, No. 3 was composed of Ni+49% Cr alloy, and No. 4 was composed of Ni+10% Mo alloy. Comparison between the coating metal samples Nos. 1 to 14 and control samples Nos. 1 to 6 shows that the coating metals based on Ni and which contained 10–50 wt% Cr and 3–35 wt% Mo were effective for preventing the crevice corrosion of austenitic stainless steel. If these coating metals contain a great amount of carbon as an incidental impurity, one or more elements selected from Nb, Ta and Ti must be added in an amount that satisfies the relation: $Nb\% + Ta\% + 2Ti\% > 10\ C\%$.

Comparison between the coating metal samples Nos. 15 to 23 and control samples Nos. 7 to 11 shows that the coating metals based on Ni and which contained 10–50 wt% Cr, 3–35 wt% Mo and less than 25 wt% and Fe were effective for preventing the crevice corrosion of austenitic stainless steel. If these coating metals contain a great amount of carbon as an incidental impurity, one or more elements selected from Nb, Ta and Ti must be added in an amount that satisfies the relation: Nb%+Ta%+2Ti%>10 C%.

Comparison between the coating metal samples Nos. 24 to 33 and control samples Nos. 12 to 15 shows that the coating metals based on Ni and which contained 10–50 wt% Cr, 3–35 wt% Mo and 0.5–4 wt% of B or Si or both were effective for preventing the crevice corrosion of austenitic stainless steel. If these coating metals contain a great amount of carbon as an incidental impurity, one or more elements selected from Nb, Ta and Ti must be added in an amount that satisfies the relation: Nb%+Ta%+2Ti%22 10 C%.

Comparison between the coating metal samples Nos. 34 to 43 and control samples Nos. 16 to 21 shows that the coating metals based on Ni and which contained 10–50 wt% Cr, 3–35 wt% Mo, less than 25 wt% of Fe and 0.5–4 wt% of B or Si or both were effective for preventing the crevice corrosion of austenitic stainless steel. If these coating metals contain a great amount of carbon as an incidental impurity, one or more elements selected from Nb, Ta and Ni must be added in an amount that satisifies the relation: Nb%+Ta%+-2Ti%>10 C%.

EXAMPLE 2

Cobalt- or cobalt-nickel based coating metal samples Nos. 44 to 65 of this invention (Nos. 44 to 55 were Co-based, and Nos. 56 to 65 were Co-Ni based) and control samples Nos. 22 to 38 were prepared. The amounts of the respective alloying elements are shown in Table 2 together with the results of crevice corrosion tests conducted with these samples. Comparison between coating metal samples Nos. 44 to 49 and control samples Nos. 22 to 31 show that the coating metals based on Co and which contained 10–50 wt% Cr and 3–35 wt% Mo were as effective as the nickel-based coating metals in preventing the crevice corrosion of austenitic stainless steel. It is also clear that if the coating metals contain a great amount of C as an incidental impurity, a predetermined amount of Nb, Ta or Ti must be added to them. Coating metal samples Nos. 50–55 show that Co-based coating metals that contain 10–50 wt% Cr, 3–35 wt% Mo, and less than 25 wt% Fe and-/or 0.5–4 wt% B or Si or both were as effective as the nickel-based coating metals in preventing the crevice corrosion of austenitic stainless steel. The data in Table 2 shows that a coating metal (such as Control sample No. 32) containing more than 25 wt% of Fe was not effective in preventing crevice corrosion, whereas a coating metal containing 0.5 to 4 wt% of Si or B or both was effective in preventing crevice corrosion. A great amount of carbon contained in the coating metal as an incidental impurity has no adverse effect if it contains the predetermined amount of one or more elements selected from Nb, Ta or Ti. The coating metal samples Nos. 56 to 65 were based on Ni-Co, and they were prepared to verify our assumption that Ni-Co based alloys containing Ni and Co in various proportions would be as effective in preventing crevice corrosion as coating metal samples Nos. 1 to 55 that demonstrated that the requirements for coating metals to exhibit the desired protection of austenitic stainless steel against crevice corrosion were the same whether they were Ni-based or Co-based. In the experiments we conducted, the coating metal samples Nos. 56 to 65 were prepared from melts composed of equal amounts of Ni and Co. As is clear from the comparison between coating metal samples Nos. 56 to 65 and control samples Nos. 34 to 38, Ni-based alloys containing 10–50 wt% Cr and 3–35 wt% Mo could be replaced by a desired amount of Co, and their ability to prevent crevice corrosion of austenitic stainless steel did not vary with the Ni to Co ratio. If the Ni-Co based coating metals contain a great amount of C as an incidental impurity, the predetermined amount of one or more elements selected from Nb, Ta and Ti must be added.

Preparation of test setup and testing procedure

Figure 2:
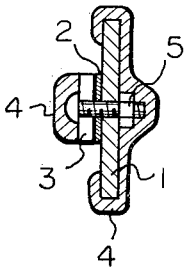
FIG. 2 is a cross section of the setup of FIG. 1.

The Samples identified in Tables 1 and 2 were melted under vacuum and poured into a crucible where they were solidified to form ingots and a square test piece having a side of 30 mm was cut from each ingot. As shown in FIGS. 1 and 2, a Teflon sheet 2 having a side of 10 mm was fastened to the central part of the test piece 1 with a bolt and nut 5 via a polycarbonate washer, and the back side and the periphery of the piece 1 were covered with an epoxy resin 4. A plurality of test pieces were prepared from each of the coating metal samples of this invention Nos. 1–65, the conventional samples Nos. 1–5, and control samples Nos. 1–38.

Figure 3A:
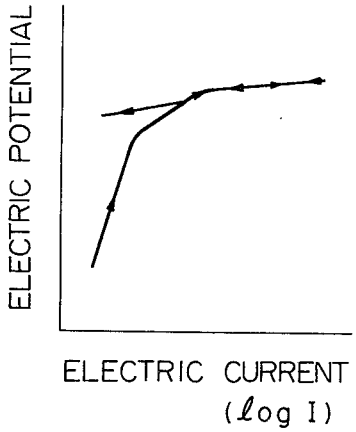
FIG. 3 is a schematic representation of typical examples of the repeated anodic polarization curve for the coating metal of this invention.
Figure 3B:
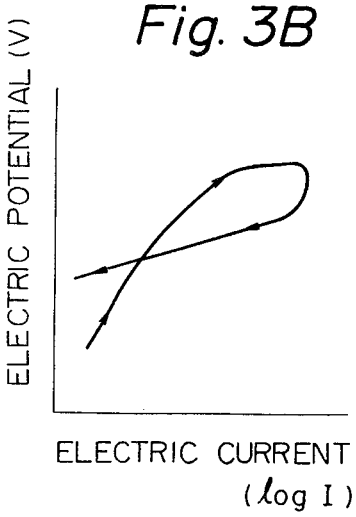
Figure 3C:
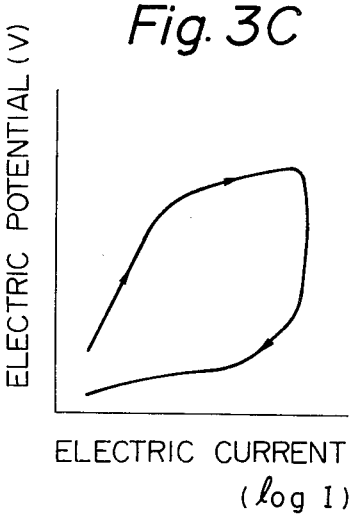

The degree of crevice corrosion on the test piece 1 due to the seawater within the small crevice between that piece and the Teflon sheet 2 was checked by determining the profile of repeated anodic polarization with the setup immersed in synthetic seawater (3% aqueous NaCl). Typical examples of the repeated anodic polarization curve are shown schematically in FIG. 3. FIG. 3A, 3B and 3C are profiles obtained by first changing the potential continuously from the natural potential to a noble potential (in forward direction) until the current was 6 mA and the changing the potential to a less noble potential (in reverse direction). In FIG. 3A, there is little difference between the profile in forward direction and that in reverse direction, and this shows that the sample has good resistance to crevice corrosion. In FIG. 3C, the sample exhibits entirely different profiles between anodic polarization in forward and reverse directions; the corrosion rate is not reduced even when the potential is returned to a less noble potential and under this condition, crevice corrosion is apt to develop because once started corrosion does not stop. FIG. 3B shows a state wherein the severity of corrosion is in between those represented by FIG. 3A and C. In Tables 1 and 2, the results of the crevice corrosion test are represented in terms of A, B and C that correspond to FIG. 3A, 3B and 3C, and at the same time, the severity of crevice corrosion is represented on a three-rank basis: o . . . crevice corrosion did not develop, X . . . crevice corrosion developed, Δ. . . crevice corrosion developed in some test pieces of the same sample.

FIG. 5 are photographs showing the results of the crevice corrosion tests with the setup described above. FIG. 5A shows that the surface of the area of the coating metal of this invention that surrounded the Teflon sheet 2 was not attacked by crevice corrosion of the seawater (corresponding to the symbol o in Table 1). FIG. 5B shows that the surface of the conventional sample that surrounded the Teflon sheet 2 was attached by crevice corrosion of the seawater (corresponding to the symbol X in Table 1). FIGS. 5C and 5D show the states that correspond to the symbol Δ in Table 1.

As is clear from Tables 1 and 2, both the conventional and control samples were attached by crevice corrosion and the result of repeated anodic polarization with them was either C or B, whereas none of the samples of the coating metal of this invention were attacked by crevice corrosion and the result of repeated anodic polarization with them was A.

TABLE 1

| | No. | Alloying Elements (%) Ni | Co | Cr | Mo | Fe | Si | B | Ta | Nb | Ti | Mn | C | S | Crevice Corrosion | Result of repeated anodic polarization |
|---|---|---|---|---|---|---|---|---|---|---|---|---|---|---|---|---|
| Samples of this invention | 1 | bal. | | 10 | 18 | | | | | | | | | | O | A |
| | 2 | " | | 10 | 34 | | | | | | | | | | O | A |
| | 3 | " | | 15 | 9 | | | | | | | | | | O | A |
| | 4 | " | | 19 | 28 | | | | | | | | | | O | A |
| | 5 | " | | 22 | 3 | | | | | | | | | | O | A |
| | 6 | " | | 22 | 7 | | | | 0.3 | 0.5 | | | 0.07 | | O | A |
| | 7 | " | | 25 | 6 | | | | | | | 2.1 | | 0.03 | O | A |
| | 8 | " | | 28 | 5 | | | | | | | | | | O | A |
| | 9 | " | | 33 | 4 | | | | | | 0.31 | | 0.05 | | O | A |
| | 10 | " | | 34 | 3 | | | | | | | 2.3 | | 0.02 | O | A |
| | 11 | " | | 34 | 8 | | | | | | | | | | O | A |
| | 12 | " | | 49 | 3 | | | | | | | | | | O | A |
| | 13 | " | | 34 | 20 | | | | | | | | | | O | A |
| | 14 | " | | 34 | 32 | | | | | | | | | | O | A |
| | 15 | " | | 16 | 25 | 9 | | | | | | | | | O | A |
| | 16 | " | | 34 | 7 | 20 | | | | | | | | | O | A |
| | 17 | " | | 21 | 4 | 23 | | | | | | | | | O | A |
| | 18 | " | | 27 | 5 | 5 | | | | | | | | | O | A |
| | 19 | " | | 35 | 8 | 1 | | | | | | | | | O | A |
| | 20 | " | | 21 | 7 | 19 | | | 0.6 | 0.5 | | | 0.09 | | O | A |
| | 21 | " | | 34 | 4 | 17 | | | | | 0.32 | | 0.04 | | O | A |
| | 22 | " | | 31 | 6 | 21 | | | | | | 2.3 | | 0.04 | O | A |
| | 23 | " | | 32 | 28 | 10 | | | | | | | | | O | A |
| | 24 | " | | 33 | 7 | | 3 | 3 | | | | | | | O | A |
| | 25 | " | | 22 | 6 | | 3 | | | | | | | | O | A |
| | 26 | " | | 35 | 3 | | | 3 | | | | | | | O | A |
| | 27 | " | | 28 | 5 | | | 1 | | | | | | | O | A |
| | 28 | " | | 34 | 4 | | | 2 | 0.50 | 0.05 | | | 0.08 | | O | A |
| | 29 | " | | 24 | 6 | | 1 | | 0.40 | 0.80 | | | 0.09 | | O | A |
| | 30 | " | | 22 | 7 | | 3 | | | | | 2.1 | | 0.08 | O | A |
| | 31 | " | | 33 | 4 | | | 1 | | | | 2.0 | | 0.07 | O | A |
| | 32 | " | | 11 | 30 | | | 0.5 | | | | | | | O | A |
| | 33 | " | | 11 | 15 | | 0.5 | | | | | | | | O | A |
| | 34 | " | | 34 | 3 | 22 | | 1 | | | | | | | O | A |
| | 35 | " | | 21 | 8 | 21 | 3 | | | | | | | | O | A |
| | 36 | " | | 29 | 6 | 18 | 2 | | | | | | | | O | A |
| | 37 | " | | 22 | 7 | 15 | 3 | | 0.06 | 0.06 | | | 0.06 | | O | A |
| | 38 | " | | 33 | 5 | 20 | | 1 | 0.80 | 0.40 | | | 0.08 | | O | A |
| | 39 | " | | 29 | 5 | 17 | | 2 | 0.40 | 1.10 | | | 0.08 | | O | A |
| | 40 | " | | 20 | 8 | 20 | 3 | | | | | 2.4 | | 0.07 | O | A |
| | 41 | " | | 34 | 4 | 18 | | 1 | | | | 1.9 | | 0.05 | O | A |
| | 42 | " | | 33 | 6 | 12 | 2 | | | | | 2.0 | | 0.07 | O | A |
| | 43 | " | | 12 | 29 | 9 | | 3 | | | | | | | O | A |
| Conventional Samples | 1 | | (SUS 316 L) | | | | | | | | | | | | X | C |
| | 2 | bal. | | 10 | | | | | | | | | | | X | C |
| | 3 | " | | 49 | | | | | | | | | | | X | B |
| | 4 | " | | | 10 | | | | | | | | | | Δ | C |
| | 5 | 100 | | | | | | | | | | | | | X | C |
| Control Samples | 1 | bal. | | 15 | 7 | | | | | | | | | | X | C |
| | 2 | " | | 30 | 1 | | | | | | | | | | X | B |
| | 3 | " | | 20 | 7 | | | | 0.07 | 0.04 | | | 0.18 | | X | C |
| | 4 | " | | 32 | 4 | | | | 0.03 | 0.05 | | | 0.14 | | X | B |
| | 5 | " | | 7 | 13 | | | | | | | | | | X | B |
| | 6 | " | | 7 | 26 | | | | | | | | | | Δ | B |
| | 7 | " | | 20 | 6 | 30 | | | | | | | | | Δ | C |
| | 8 | " | | 12 | 7 | 22 | | | | | | | | | X | C |
| | 9 | " | | 33 | 2 | 19 | | | | | | | | | Δ | B |
| | 10 | " | | 21 | 6 | 23 | | | 0.20 | 0.50 | | | 0.09 | | X | C |
| | 11 | " | | 31 | 3 | 21 | | | | | 0.80 | | | | X | B |
| | 12 | " | | 10 | 8 | | | 1 | | | | | | | X | C |
| | 13 | " | | 31 | 1 | | 3 | | | | | | | | X | B |
| | 14 | " | | 22 | 8 | | | 3 | 0.10 | 0.70 | | | 0.09 | | X | B |
| | 15 | " | | 34 | 3 | | 1 | | | | 0.20 | | 0.06 | | Δ | C |
| | 16 | " | | 17 | 7 | 24 | 3 | | | | | | | | X | C |
| | 17 | " | | 33 | 1 | 20 | | | | | | | | | X | C |
| | 18 | " | | 20 | 6 | 30 | 1 | | | | | | | | Δ | C |
| | 19 | " | | 21 | 7 | 21 | 3 | | 0.50 | 0.1 | | | 0.07 | | X | B |
| | 20 | " | | 34 | 4 | 19 | | 1 | | | 0.40 | | 0.08 | | X | B |
| | 21 | " | | 7 | 20 | 18 | 1 | | | | | | | | X | B |

TABLE 2

| | No. | Alloying Elements (%) Ni | Co | Cr | Mo | Fe | Si | B | Ta | Nb | Ti | Mn | C | S | Crevice corro-sion | Result of repeated anodic pola-rization |
|---|---|---|---|---|---|---|---|---|---|---|---|---|---|---|---|---|
| Samples of this invention | 44 | | bal. | 11 | 35 | | | | | | | | | | O | A |
| | 45 | | " | 11 | 12 | | | | | | | | | | O | A |
| | 46 | | " | 24 | 3 | | | | | | | | | | O | A |
| | 47 | | " | 33 | 8 | | | | | | | | | | O | A |
| | 48 | | " | 44 | 4 | | | | | | | | | | O | A |
| | 49 | | " | 20 | 6 | | | | | | 0.70 | | 0.1 | | O | A |
| | 50 | | " | 13 | 14 | 9 | | | | | | | | | O | A |
| | 51 | | " | 21 | 3 | 23 | | | | | | | | | O | A |
| | 52 | | " | 21 | 8 | | 1 | 3 | | | | | | | O | A |
| | 53 | | " | 26 | 5 | 20 | | 1 | | | | | | | O | A |
| | 54 | | " | 41 | 3 | 8 | | | | | | | | | O | A |
| | 55 | | " | 34 | 7 | 19 | | | | 0.30 | | | 0.02 | | O | A |
| | 56 | bal. | Ni:Co 1:1 | 13 | 25 | | | | | | | | | | O | A |
| | 57 | " | " | 10 | 12 | | | | | | | | | | O | A |
| | 58 | " | " | 18 | 7 | | | | | | | | | | O | A |
| | 59 | " | " | 25 | 25 | | | | | | | | | | O | A |
| | 60 | " | " | 25 | 8 | | | | | | | | | | O | A |
| | 61 | " | " | 25 | 3 | | | | | | | | | | O | A |
| | 62 | " | " | 31 | 8 | 21 | | | | | | | | | O | A |
| | 63 | " | " | 47 | 6 | | | 2 | | | | | | | O | A |
| | 64 | " | " | 35 | 3 | 8 | 1 | | | 0.6 | | | 0.03 | | O | A |
| | 65 | " | " | 22 | 3 | | 3 | | | | | 2.1 | | 0.03 | O | A |
| Control samples | 22 | | 100 | | | | | | | | | | | | X | C |
| | 23 | | 50 | 25 | | | | | | | | | | | X | B |
| | 24 | | 85 | 15 | | | | | | | | | | | X | C |
| | 25 | 25 | 25 | 50 | | | | | | | | | | | X | B |
| | 26 | | 70 | | 30 | | | | | | | | | | Δ | B |
| | 27 | | bal. | 5 | 16 | | | | | | | | | | X | C |
| | 28 | | " | 5 | 5 | | | | | | | | | | X | C |
| | 29 | | " | 14 | 5 | | | | | | | | | | X | C |
| | 30 | | " | 25 | 5 | | | | 0.70 | | | | 0.09 | | X | B |
| | 31 | | " | 40 | 2 | | | | | | | | | | Δ | B |
| | 32 | | " | 22 | 4 | 30 | | | | | | | | | Δ | C |
| | 33 | | " | 17 | 5 | 8 | | | | | | | | | Δ | C |
| | 34 | bal. | Ni:Co 1:1 | 10 | 7 | | | | | | | | | | X | B |
| | 35 | " | " | 16 | 2 | | | | | | | | | | X | C |
| | 36 | " | " | 34 | 2 | | | | | | | | | | X | C |
| | 37 | " | " | 18 | 7 | 35 | | | | | | | 0.06 | | X | C |
| | 38 | " | " | 6 | 25 | 9 | | | | | | | | | X | B |

EXAMPLE 3

Figure 6A:
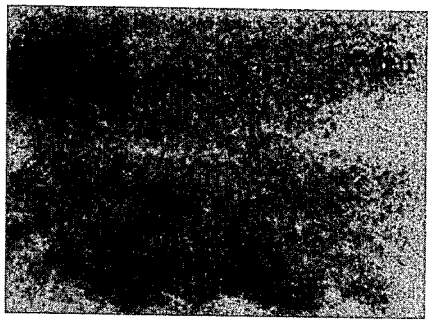
FIG. 6 is photographs showing the surface of three coating applying metals by gun.
Figure 6B:
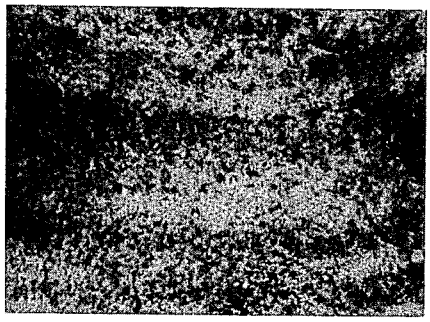
Figure 6C:
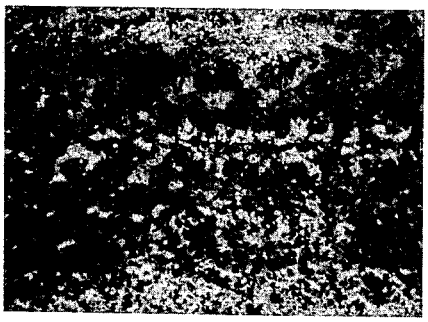

In this example, the uniformity and smothness of the layer of coating metals containing Si or B were tested. The layer of coating metal formed on the surface of austenitic stainless steel is desirably as thin as possible because this reduces the amount of the coating metal required, hence the cost, and in addition, the austenitic stainless steel with the thin layer of coating metal on can be put to service without machining for providing a smooth surface. In this example, the coating metals of this invention were applied to the surface of austenitic stainless steel by gunning using nitrogen gas as a carrier, and a thin layer of coating metal (about 0.2 mm) was formed. FIG. 6A is a photograph that shows the surface of the coating metal sample No. 25 which, because of the presence of 3% Si, provided a uniform protective layer throughout the surface. FIG. 6B is a photograph that shows the surface of the coating metal sample No. 33 which, because of the presence of 0.5% Si, provided a reasonably uniform protective layer throughout the surface. FIG. 6C is a photograph that shows the surface of the coating metal sample No. 11 which, because of the absence of Si and B, did not provide a uniform coating and left the surface of austenitic stainless steel partially exposed. Therefore, a thicker coating is necessary to achieve complete protection against the crevice corrosion of austenitic stainless steel and the obtained coating needs further machining depending on where it is to be used. As is clear from the photographs 5A to 5C, the coating metals of this invention containing B or Si provide a very uniform and smooth coating as compared with the sample containing neither B nor Si.

The coating metals of this invention have a melting point lower than that of austenitic stainless steel (1430° C.), and they achieve the intended effect simply by forming a thin layer (about 0.3 mm) of them on the base metal by gun-melting or soft plasma generator. No pores or impurities such as oxides will be formed in the layer being formed of these coating metals.

The advantages of the ingredients incorporated in the coating metal of this invention are as follows. Iron contained in a suitable amount reduces the cost of the resulting coating metal. An alloy containing Si or B or both has a liquidus temperature that is lower than that of an alloy of the same composition which does not contain Si or B. The difference is about 205° C. in the absence of Fe and about 85° C. in the presence of Fe. Because of this, the alloy containing Si or B or both is very easy to apply to the surface of austenitic stainless steel. At least one element selected from Nb, Ta and Ti and which is contained in the predetermined amount prevents the formation of a carbide due to C contained in the coating metal as an incidental impurity, thus eliminating the chance of reducing the corrosion resistance of the coating metal. Manganese contained in the predetermined amount is able to prevent high-temperature cracking due to sulfur that is also contained in the coating metal as an incidental impurity.

As described in the foregoing, the coating metal of this invention assures full protection against crevice corrosion of austenitic stainless steel in a corrosive fluid such as seawater by simply forming a thin layer of the coating metal on the area of the part of the stainless steel that forms a small crevice with another object. The formation of a protective layer only on the required area results in great economy yet achieves extended protection against corrosion of machines, equipment and components that are in contact with the seawater. What is more, the low melting point of the coating metal is particularly effective in assuring easy application onto the austenitic stainless steel.

Figure 4:
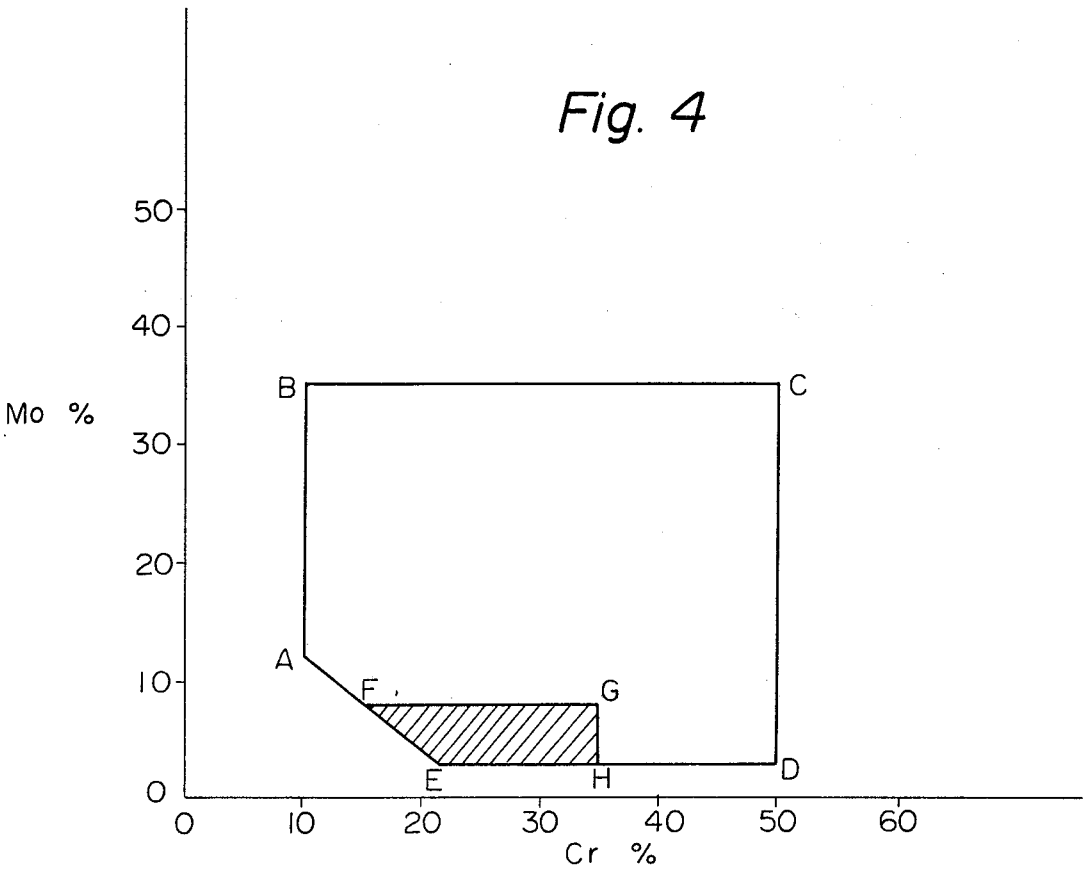
FIG. 4 is a diagram defining the composition of the coating metal of this invention by the polygon A-B-C-D-E, wherein the preferred range is E-F-G-H.
Figure 5A:
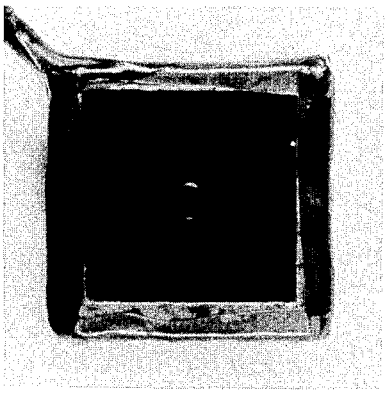
FIG. 5 is photographs showing the results of a crevice corrosion test conducted with the setup of FIG. 1.
Figure 5B:
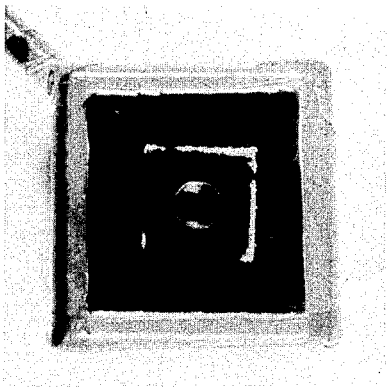
Figure 5C:
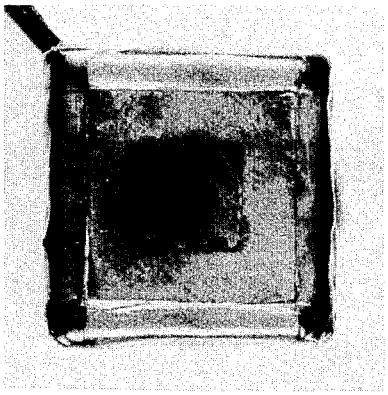
Figure 5D:
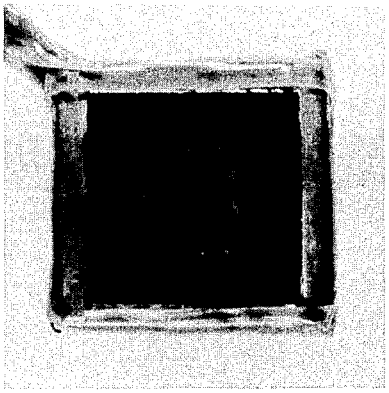

What is claimed is:

1. A method of preventing the crevice corrosion of austenitic stainless steel to be placed in a corrosive environment by applying a molten alloy of the following composition onto the surface of the area of austenitic stainless steel that is to be in contact with another object or the area that surrounds such area: 10–50 wt% Cr, 3–35 wt% Mo and the balance being Ni or Co or both Ni and Co and incidental impurities, the Cr and Mo levels being within the range defined by A-B-C-D-E in accompanying FIG. 4.

2. A method according to claim 1 wherein Cr is 15–35 wt% and Mo is 3–8 wt%, the Cr and Mo levels being within the range defined by E-F-G-H in accompanying FIG. 4.

3. A method of preventing the crevice corrosion of austenitic stainless steel to be placed in a corrosive environment by applying a molten alloy of the following composition onto the surface of the area of austenitic stainless steel that is to be in contact with another object or the area that surrounds such area: 10–50 wt% Cr, 3–35 wt% Mo, the Cr and Mo levels being within the range defined by A-B-C-D-E in accompanying FIG. 4, less than 0.15 wt% C, more than 10×C wt% of at least one element selected from the group consisting of Nb, Ta and Ti (the Ti level is doubled), and the balance being Ni or Co or both Ni and Co and incidental impurities.

4. A method according to claim 3 wherein Cr is 15–35 wt% and Mo is 3–8 wt%, the Cr and Mo levels being within the range defined by E-F-G-H in accompanying FIG. 4.

5. A method of preventing the crevice corrosion of austenitic stainless steel to be placed in a corrosive environment by applying a molten alloy of the following composition onto the surface of the area of austenitic stainless steel that is to be in contact with another object or the area that surrounds such area: 10–50 wt% Cr, 3–35 wt% Mo, the Cr and Mo levels being within the range defined by A-B-C-D-E in accompanying FIG. 4, at least one element selected from the group consisting of Fe, Si and B, Fe being less than 25 wt%, Si being 0.5–4 wt%, and B being 0.5–4 wt%, and the balance being Ni or Co or both Ni and Co and incidental impurities.

6. A method according to claim 5 wherein Cr is 15–35 wt% and Mo is 3–8 wt%, the Cr and Mo levels being within the range defined by E-F-G-H in accompanying FIG. 4.

7. A method according to claim 5 wherein Cr is 15–35 wt%, Mo is 3–8 wt%, the Cr and Mo levels being within the range defined by E-F-G-H in accompanying FIG. 4, and at least one element selected from the group consisting of Fe, Si and B, Si being 1–4 wt% and B being 1–4 wt%.

8. A method of preventing the crevice corrosion of austenitic stainless steel to be placed in a corrosive environment by applying a molten alloy of the following composition onto the surface of the area of austenitic stainless steel that is to be in contact with another object or the area that surrounds such area: 10–50 wt% Cr, 3–35 wt% Mo, the Cr and Mo levels being within the range defined by A-B-C-D-E in accompanying FIG. 4, less than 0.15 wt% C, at least one element selected from the group consisting of Fe, Si and B, Fe being less than 25 wt%, Si being 0.5–4 wt% and B being 0.5–4 wt%, more than 10×C wt% of at least one element selected from the group consisting of Nb, Ta and Ti (the Ti level is doubled), and the balance being Ni or Co or both Ni and Co and incidental impurities.

9. A method according to claim 8 wherein Cr is 15–35 wt% and Mo is 3–8 wt%, the Cr and Mo levels being within the range defined by E-F-G-H in accompanying FIG. 4.

10. A method according to claim 8 wherein Cr is 15–35 wt%, Mo is 3–8 wt%, the Cr and Mo levels being within the range defined by E-F-G-H in accompanying FIG. 4, and at least one element selected from the group consisting of Fe, Si and B, Si being 1–4 wt% and B being 1–4 wt%.

* * * * *